US009846009B1

(12) United States Patent
McDaniels

(10) Patent No.: US 9,846,009 B1
(45) Date of Patent: Dec. 19, 2017

(54) INTERCHANGEABLE SCOPE LENS COVERS

(75) Inventor: Denny McDaniels, Westminster, CO (US)

(73) Assignee: Engineered Outdoor Products, LLC, Loveland, CO (US)

( * ) Notice: Subject to any disclaimer, the term of this patent is extended or adjusted under 35 U.S.C. 154(b) by 0 days.

(21) Appl. No.: 13/134,718

(22) Filed: Jun. 15, 2011

Related U.S. Application Data

(60) Provisional application No. 61/397,824, filed on Jun. 17, 2010.

(51) Int. Cl.
*F41G 1/38* (2006.01)

(52) U.S. Cl.
CPC ..... *F41G 1/383* (2013.01); *F41G 1/38* (2013.01)

(58) Field of Classification Search
CPC ..... F41G 1/383; F41G 1/38; G02B 23/16
USPC ..... 42/129, 90; 359/894, 511
See application file for complete search history.

(56) References Cited

U.S. PATENT DOCUMENTS 2,972,190 A * 2/1961 Vissing ..... F41G 1/383 359/511
3,426,433 A * 2/1969 Anderson ..... F41G 1/383 359/511
3,496,642 A * 2/1970 Pfahler ..... F41G 1/383 359/511
5,020,894 A * 6/1991 Weyrauch ..... F41G 1/383 359/511
5,495,676 A * 3/1996 Chesnut ..... F41G 1/383 359/511
5,566,490 A * 10/1996 Owen ..... F41G 1/383 42/129
7,721,480 B2 * 5/2010 Campean ..... F41G 1/383 42/129
2002/0167731 A1 * 11/2002 Watson ..... G02B 6/29358 359/578

* cited by examiner

*Primary Examiner* — John Cooper
(74) *Attorney, Agent, or Firm* — Craig R. Miles; CR Miles P.C.

(57) ABSTRACT

An interchangeable scope lens covers system comprises a pair of lens covers each comprising a lens cover sleeve that is generally shaped like a hollow cylinder having a generally decreasing diameter from a proximal end to a distal end. Near the distal end, a generally annular lens is removably secured by a lens cap. The lenses are therefore easily removed and interchanged as desired by the user to configure the system to respond to changing shooting conditions. Between the pair of lens covers is attached a plurality of elastic cords or similar materials that hold the lens covers tightly against both ends of a scope tube in order to provide a press fit that keeps moisture, debris, etc. from entering the space between the lens covers and the scope lenses. The press fit forms a seal or barrier between the lens covers and the scope.

20 Claims, 5 Drawing Sheets

200

INTERCHANGEABLE SCOPE LENS COVERS

CROSS-REFERENCE TO RELATED APPLICATIONS

This application claims the benefit of U.S. Provisional Application No. 61/397,824 entitled "Interchangeable Firearm Scope Lens Covers" and filed on Jun. 17, 2010.

TECHNICAL FIELD

The invention relates generally to telescopic sights for firearms and more particularly, but not by way of limitation, to interchangeable scope lens covers.

BACKGROUND

There are many different types of sighting/aiming devices for firearms. Traditional devices include open sights, peep sights, etc. In relatively recent times, telescopic sights have gained in popularity and are a common means for sighting/aiming firearms, including rifles, pistols, shotguns, black-powder weapons, air rifles, crossbows, etc. As some scopes do not magnify the sight picture and otherwise have somewhat departed in form and function from the standard telescopic sights, the term "scope" is used to encompass all such related devices. Scopes often comprise a single tube of aluminum or other material containing therein a plurality of lenses that gather and/or magnify incoming light. They are designed for light to enter the objective end of the scope and be transmitted to the ocular end or eyepiece and then on to a user's eye. Commonly, scopes employ one or more reticles, often referred to as crosshairs, to aid the user in aligning the scope with the target in the sight picture provided to the user when he or she looks into the eyepiece. Since scopes are usually attached to firearms in a fixed manner, by aligning the scope with the target, the user is automatically aligning the firearm as well. Some scopes incorporate electronics such as lights, lighted-reticles, and/or laser range-finding devices.

Regardless of the internal components of a scope, both ends of a scope's tube (the objective end and the ocular end) are sealed with relatively delicate lenses. As such lenses are generally made from glass or other delicate materials, it is desirable to protect them from damage. Furthermore, moisture (fog, rain, snow, etc.) can reduce the effectiveness and usability of scopes if said moisture is allowed to impact and/or collect upon the surfaces of lenses.

Therefore, what is needed is a means for protecting the external surfaces of the external lenses in a rifle scope. A number of lens-protection devices have been developed in the art. Many known devices use opaque scope covers that have to be removed before the scope can be employed. Such devices may cause difficulties if, for example, in a hunting situation, the scope must be quickly employed before the target no longer presents a good shot. In such cases, taking the time to manually remove an opaque scope cover can cause the user to miss a shot opportunity. In response to these difficulties, some devices have been developed that utilize generally transparent covers that allow a user to sight through a scope without removing the lens covers. Although an improvement, such systems have other limitations, including that they are fixed-lens protective devices and when such devices become scratched, worn, clouded, etc., the covers no longer provide a clear sight picture and thus again necessitate removal of the covers prior to utilizing the scope. In an attempt to solve this problem, other known devices use quick-release or flip-up lens covers which still require that the user have time to activate such mechanisms before the scope can be properly employed.

An additional problem with known lens covers is that they employ a permanent or fixed lens cover that is not quickly and easily customized or interchanged. For example, such devices may employ a shaded lens cover for use on bright, sunny days. However, if the device is employed in low-light conditions (such as near dawn or dusk), the shaded lens cover reduces the light transmission through the scope resulting in the user not being able to properly see a target. Similarly, some devices employ amber lens covers that can be useful in certain shooting circumstances but are a detriment in others.

Yet another problem inherent in known lens covers is that they are designed to either loosely fit a small range of scope sizes or more tightly fit a single scope size. An obvious problem with the former type of devices is that they can allow rain, fog, snow, debris, dust and moisture to enter the space between the lens covers and the lenses, thus defeating the purpose of the lens covers. The latter type of devices may do a better job of keeping out such offending substances, but they can only be employed on scopes of a single size, thus requiring a user to purchase a large number of such devices in various sizes in order to properly protect all the differently sized scopes that a particular user may own.

Thus, what is needed is an interchangeable scope lens cover system that allows a user to quickly and easily change out old, scratched lens covers for new, un-blemished covers while simultaneously allowing a user to select from multiple types of lens covers including, but not limited to: clear, shaded, colored, polarized, amber, smoke, glass, polycarbonate, anti-glare, UV-blocker, etc. (or a combination thereof). Further, the lens cover system should also be designed to provide a press fit on a number of differently sized scopes in order to maximize the scope lens cover system's interoperability with various scopes while maintaining a high level of scope lens protection.

SUMMARY

One embodiment of the present invention is a device comprising a pair of lens covers each comprising a lens cover sleeve that is generally shaped like a hollow cylinder having a generally decreasing diameter from a proximal end to a distal end. Near the distal end, a generally annular lens is removably secured by a lens cap. The lenses are therefore easily removed and interchanged as desired by the user to configure the system to respond to changing shooting conditions. Between the pair of lens covers is attached a plurality of elastic cords or similar materials that hold the lens covers tightly against both ends of a scope tube in order to provide a press fit that keeps moisture, debris, etc. from entering the space between the lens covers and the scope lenses. The press fit forms a seal or barrier between the lens covers and the scope. Furthermore, as there are known a number of scopes that utilize tubes having an objective end (and/or an ocular end) that is not generally annular in shape, other embodiments of the present invention include lens covers that are shaped to match. Examples of such shapes include, but are not limited to: an ellipse, a circle with its top and bottom curves replaced with relatively straight horizontal line portions, a circle with an indent on its bottom curve to allow the scope's objective to be placed very close to a rifle barrel, etc.

BRIEF DESCRIPTION OF THE DRAWINGS

The aforementioned and other features and objects of the present invention and the manner of attaining them will become more apparent and the invention itself will be best understood by reference to the following descriptions of a preferred embodiment and other embodiments taken in conjunction with the accompanying drawings, wherein.

DETAILED DESCRIPTION

In the following discussion, numerous specific details are set forth to provide a thorough understanding of the present invention. However, those skilled in the art will appreciate that the present invention may be practiced without such specific details.

Figure 1:
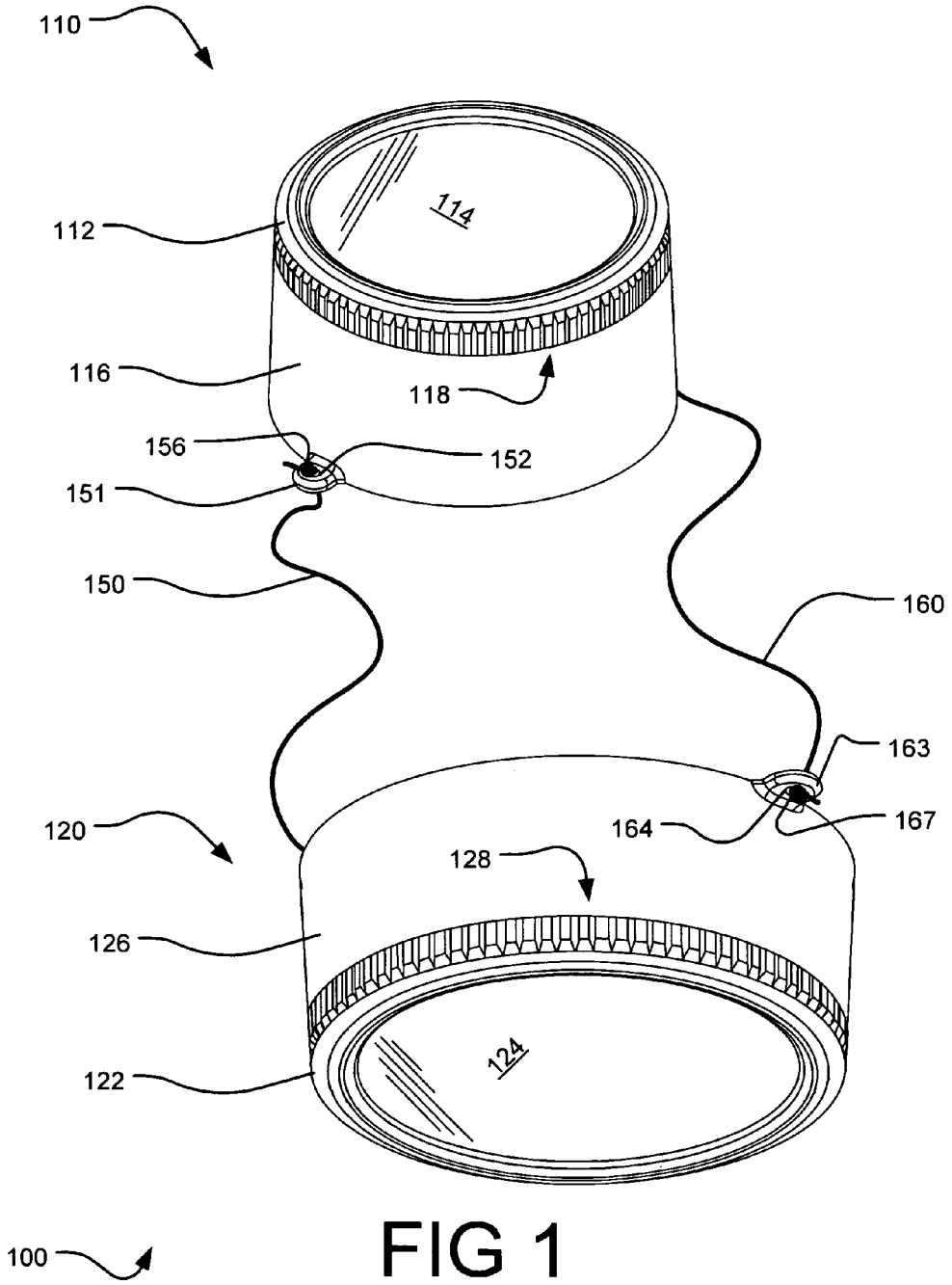
FIG. 1 illustrates a perspective view of an exemplary embodiment of an interchangeable scope lens covers system.

Referring now to the drawings, FIG. 1 illustrates a perspective view of an exemplary embodiment of an interchangeable scope lens covers system 100. The system comprises a pair of scope lens covers 110 and 120 attached to each other via a plurality of elastic cords 150 and 160. In the embodiment shown in FIG. 1, two elastic cords 150 and 160 are depicted; in other embodiments, the plurality of elastic cords 150 and 160 can comprise one, two, three, four, or more elastic cords 150 and 160. In yet other embodiments, the elastic cords 150 and 160 are not actually made from elastic cording material; "elastic cords" is to be interpreted to include cords, bands, strips, strings, etc. that are made of rubber, stretch cord, or any other suitable material that provides a stretchy, elastic means of holding the scope lens covers 110 and 120 to the ocular and objective ends of a scope.

As depicted in FIG. 1, the first scope lens cover 110 has a first lens cap 112, a first lens 114, and a first lens cover sleeve 116. The first lens cap 112 attaches to an upper portion of the first lens cover sleeve 116 and holds the first lens 114 therebetween. Although not shown in FIG. 1, the first scope lens cover 110 utilizes a threaded lens attachment means: the first lens cap 112 and an upper portion of the first lens cover sleeve 116 are threaded so that the first lens cap 112 can be secured snugly to the first lens cover sleeve 116. In other embodiments, other attachment means are contemplated, including, but not limited to: a snap-over ring, one or more magnets, removable/reusable adhesive, etc.

As depicted in FIG. 1, the second scope lens cover 120 has a second lens cap 122, a second lens 124, and a second lens cover sleeve 126. The second lens cap 122 attaches to an upper portion of the second lens cover sleeve 126 and holds the second lens 124 therebetween. Although not shown in FIG. 1, the second scope lens cover 120 utilizes a threaded lens attachment means: the second lens cap 122 and the second lens cover sleeve 126 are threaded so that the second lens cap 122 can be secured snugly to the second lens cover sleeve 126. In other embodiments, other attachment means are contemplated, including, but not limited to: a snap-over ring, one or more magnets, removable/reusable adhesive, etc.

The ease of changing lenses 114 and 124 should be apparent: a user simply detaches the lens caps 112 and 122 from the lens cover sleeves 116 and 126, respectively, and replaces the lenses 114 and 124 with other lenses. This allows a user to quickly and easily change out old, scratched lens covers for new, un-blemished covers by only changing the lenses 114 and 124 themselves rather than having to replace the entire scope lens covers. Simultaneously, the system allows a user to select from multiple types of lenses including, but not limited to: clear, shaded, colored, polarized, amber, smoke, glass, polycarbonate, anti-glare, UV-blocker, etc. (or a combination thereof). Thus, the same interchangeable scope lens covers system can be used regardless of changing lighting/weather conditions.

The plurality of elastic cords 150 and 160 are attached to the first lens cover 110 and the second lens cover 120 and serve to keep the lens covers 110 and 120 from becoming separated and lost. Furthermore, because of the tension created by stretching the elastic cords 150 and 160 when placing the lens covers 110 and 120 in place on a scope, the lens covers 110 and 120 are tightly secured against the ocular and objective ends of a scope while in use.

As illustrated in the embodiment shown in FIG. 1, one means of attaching the elastic cords 150 and 160 to the lens covers 110 and 120 is through the use of cord attachment ears 151 and 163. Each cord 150 and 160 attaches to a pair of ears 151/153 and 161/163. Although ears 153 and 161 are not explicitly shown in FIG. 1, placement, shape, etc. can be inferred from those ears 151 and 163 which are illustrated. The ears 151 and 163 are tab-shaped protrusions near the lower portions of the lens cover sleeves 116 and 126 which have holes 152 and 164 therein through which the cords 150 and 160 can be passed and then knotted 156 and 167. This method of attaching the cords 150 and 160 to the lens cover sleeves 116 and 126 allows the user to unknot and re-knot the cords 150 and 160 to adjust the system for scopes having tubes of different lengths.

Figure 2:
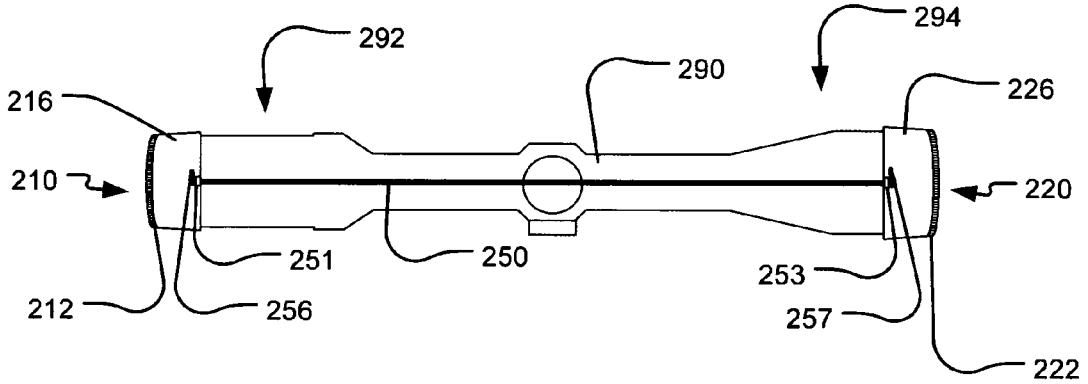
FIG. 2 illustrates an elevation view of an exemplary embodiment of an interchangeable scope lens covers system in place on a rifle scope.

The interchangeable scope lens covers system is attached to a scope by placing the lens covers 110 and 120 over the ocular end and the objective end, respectively, of the scope (see FIG. 2). The tension provided by stretching the elastic cords 150 and 160 to allow the covers 110 and 120 to fit over the ends of the scope causes the covers to have a press fit against the ends of the scope. The press fit forms a seal or barrier between the lens covers 110 and 120 and the scope (since there are two lens covers 110 and 120 a first barrier and a second barrier are formed). Furthermore, as there are known a number of scopes that utilize tubes having an objective end (and/or an ocular end) that is not generally annular in shape, other embodiments of the present invention include lens covers that are shaped to match such scopes. Examples of such shapes include, but are not limited to: an ellipse, a circle with its top and bottom curves replaced with relatively straight horizontal line portions, a circle with an indent on its bottom curve to allow the scope's objective to be placed very close to a rifle barrel and partially surrounding the rifle barrel, etc. Of course, when the lens covers 110 and 120 are not generally round in shape then other attachment means for removably attaching the lens caps 112 and 122 to the lens cover sleeves 116 and 126 besides the use of threading must be employed.

Each of the two lens caps 112 and 122 shown in the embodiment in FIG. 1 has a series of grippers 118 and 128. The first lens cap 112 has a first series of grippers 118 located on a first outer diameter and the second lens cap 122 has a second series of grippers 128 located on a second outer diameter. These provide a means for a user to easily grasp the lens caps 112 and 122 so they can be removed from the lens cover sleeves 116 and 126. In other embodiments, other type of grippers are contemplated including using rubber or some other suitable non-slippery material in the construction of the lens caps 112 and 122.

FIG. 2 illustrates an elevation view of an exemplary embodiment of an interchangeable scope lens covers system 200 in place on a rifle scope 290. The scope 290 has an ocular end 292 and an objective end 294. Although the diameter of the objective end 294 is usually larger than that of the ocular end 292, it is not a requirement. In the embodiment shown in FIG. 2, the first lens cover 210 fits over the ocular end 292 of the scope 290 and the second lens cover 220 fits over the objective end 294. In other embodiments, the lens covers 210 and 220 can be swapped.

The first lens cap 212 and second lens cap 222 are illustrated in FIG. 2 as are the first lens cover sleeve 216 and the second lens cover sleeve 226. Although the first cord attachment ear 251 and the second cord attachment ear 253 are shown, the other cord attachment ears (161/163) are not. Also illustrated in FIG. 2 are the first knot 256 and the second knot 257; the third knot (which would be numbered 266, if present) and the fourth knot (which would be numbered 267, if present) are not illustrated. It should be apparent that if the lens covers system 200 is to be redeployed on a scope 290 that has a shorter tube length than the one in FIG. 2, one or both of the knots 256 and 257 can be undone and then more of the first elastic cord 250 can be pulled through the first and/or second ears 251 and 253 and the knots 256 and 257 can be retied. This effectively shortens the length of cord 250 between the first and second lens covers 210 and 220 and provides a tighter fit on the existing scope 290 or allows for shorter scope tubes to be used. In other embodiments, the length of the elastic cord 250 is longer than that illustrated in FIG. 2 to allow the system 200 to be used for longer scope tubes.

Figure 3:
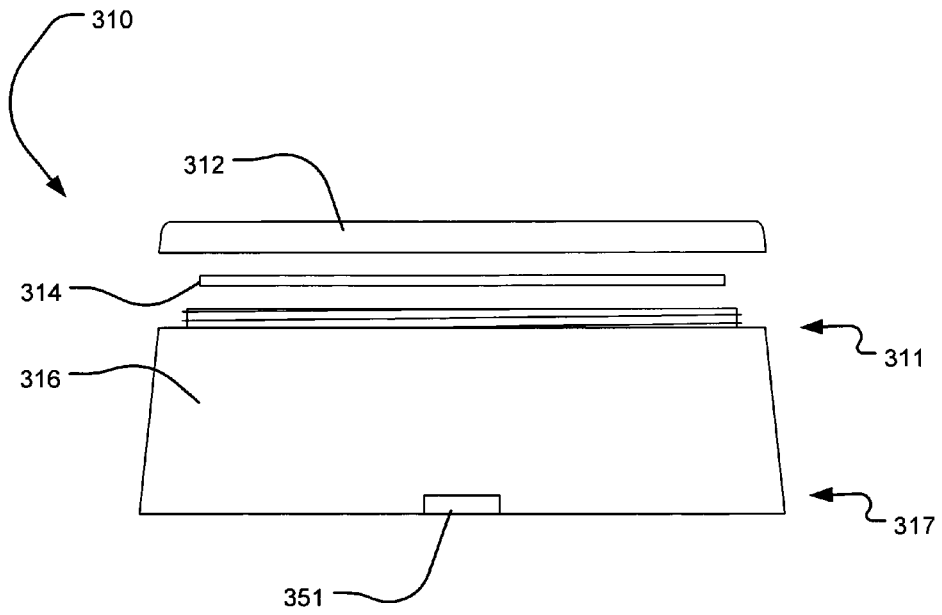
FIG. 3 illustrates an elevation exploded view of an exemplary embodiment of a lens cover.
Figure 3:
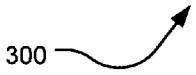

FIG. 3 illustrates an elevation exploded view of an exemplary embodiment of a lens cover 310. A first lens cap 312 is shown in a non-attached position above a first lens 314. The first lens 314 fits down inside the upper portion of the first lens cover sleeve 316. As can be seen in FIG. 3, the first lens cover sleeve 316 is shaped as a cylinder but with a decreasing diameter from its proximal end to its distal end. The proximal end is also called the first lower portion 317 and is where the cord attachment ear 351 is generally located. The distal end is also called the first upper portion 311 and is generally where the first lens cap 312 is attached.

The decreasing diameter of the lens cover sleeve 316 is an extremely useful feature as it allows the lens cover 310 to be used on scopes of various sizes while still providing a tight press fit seal between the lens cover 310 and the scope. For example, if the internal diameter of the lens cover sleeve 316 decreases from two inches to one and a half inches then the lens cover 310 can be used on scopes with an outside diameter of either the ocular or objective end of the scope ranging from one and a half to two inches. Scopes will snugly fit against the interior sidewall of the lens cover 310 wherever their outside diameter matches the inside diameter of the lens cover 310.

Figure 5:
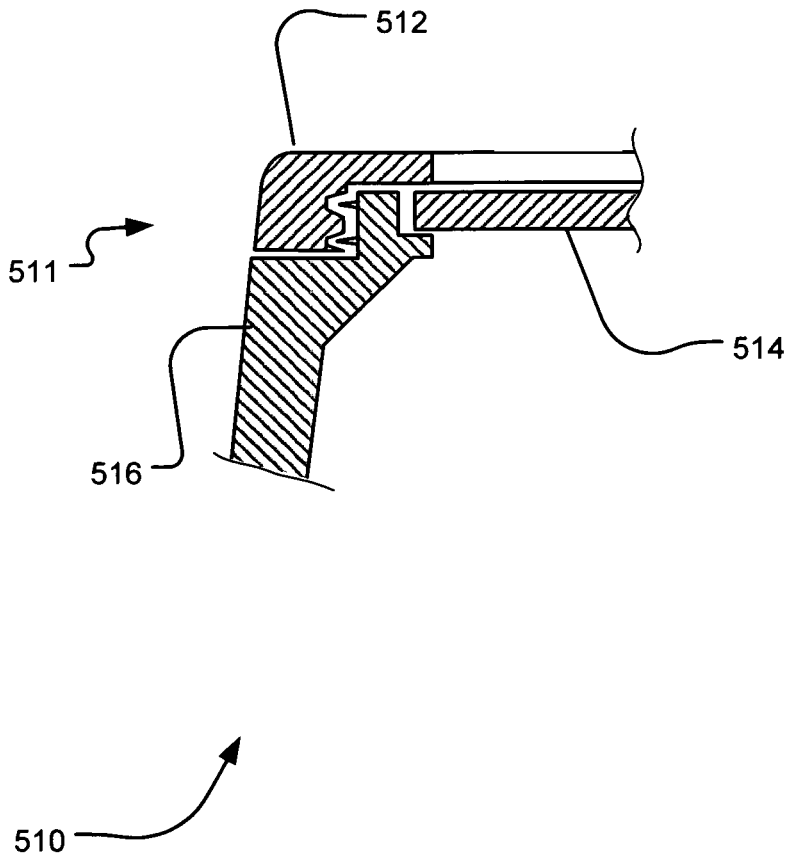
FIG. 5 illustrates a close-up of an elevation cross-sectional view of an exemplary embodiment of a lens cover.

As illustrated in the embodiment depicted in FIG. 3, the first upper portion 311 of the lens cover sleeve 316 is threaded for mating with the first lens cap 312 which is internally threaded (not shown in FIG. 3, see FIG. 5). As discussed above, in other embodiments, other attachment means besides threading is contemplated to snugly attach the first lens cap 312 to the first lens cover sleeve 316. Although not depicted in FIG. 3, in one embodiment, the second lens cover is generally shaped and sized to resemble the first lens cover 310; but as most scopes have a larger objective end versus their ocular end, the second lens cover will similarly need to have a larger internal average sidewall diameter than the first lens cover.

Figure 4:
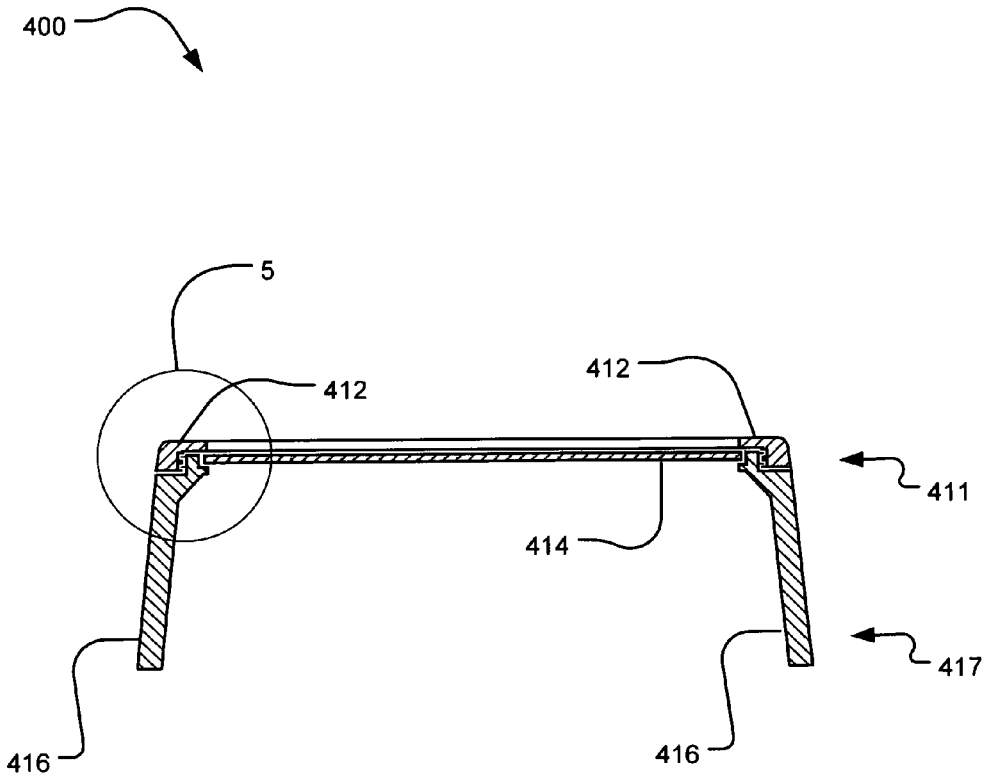
FIG. 4 illustrates an elevation cross-sectional view of an exemplary embodiment of a lens cover.
Figure 4:
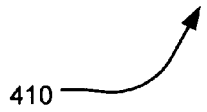

FIG. 4 illustrates an elevation cross-sectional view of an exemplary embodiment of a first lens cover 410. This view is the same as in FIG. 3 except that a cross section has been taken through the approximate center of the first lens cover 410. The shape of the side wall of the first lens cover sleeve 416 can be seen and the generally decreasing nature of its diameter from its lower portion 417 to its upper portion 411 is obvious. As depicted in FIG. 4, both the internal and external diameters of the first lens cover sleeve 416 are illustrated as generally decreasing in diameter; however, in other embodiments, the external dimensions of the first lens cover sleeve 416 could be such that its diameter is either constant or increasing from its lower portion 417 to its upper portion 411. Furthermore, the shape of the external sidewalls of the lens covers can vary in other embodiments. Although not depicted in FIG. 4, in one embodiment, the second lens cover is generally shaped and sized to resemble the first lens cover 410.

FIG. 4 also clearly illustrates how the first lens 414 is sandwiched between the first lens cap 412 and the first lens cover sleeve 416 and thereby firmly and securely held in position. For detail on the interactions between the first lens cap 412, the first lens 414 and the first lens cover sleeve 416, a highlighted area 5 provides a zoomed in view in FIG. 5.

Turning now to FIG. 5, it illustrates a zoomed-in close-up view of a portion of the elevation cross-sectional view of an exemplary embodiment of a lens cover 510 from FIG. 4. The upper portion 511 of the first lens cover sleeve 516 is shown and the threading thereon can be clearly seen. This threading engages the internal threading on the first lens cap 512 as seen in FIG. 5. The threading is configured such that by turning the first lens cap 512 about its central vertical axis while preventing the first lens cover sleeve 516 from rotating along its central vertical axis, the first lens cap 512 can be detached from the first lens cover sleeve 516. Similarly, by turning the first lens cap 512 in the other direction, its threads will engage those on the first lens cover sleeve 516 and the two will tighten together.

The location of the first lens 514 relative to the positions of the first lens cap 512 and the first lens cover sleeve 516 can be clearly seen in FIG. 5. As the first lens cap 512 is screwed onto the first lens cover sleeve 516, the first lens 514 is sandwiched between the cap 512 and the sleeve 516 and firmly secured in place. The gaps shown between the various components in FIG. 5 are accentuated for ease of interpretation of the drawing figure.

The above specification, examples and data provide a description of the structure and use of exemplary embodiments of the described articles of manufacture and methods. It will further be understood from the foregoing description that various modifications and changes may be made in the embodiments of the present invention without departing from its true spirit. This description is intended for purposes of illustration only and should not be construed in a limiting sense. The scope of this invention should be limited only by the language of the following claims.

What is claimed is:

1. An interchangeable scope lens covers system, comprising:

a first scope lens cover including a first lens cover sleeve, a first lens cap, and a first lens;

said first lens cover sleeve including a tubular body having a length disposed between a first upper portion and a first lower portion of said tubular body and a first internal surface of said tubular body generally decreasing from said first lower portion of said first lens cover sleeve toward said first upper portion of said first lens cover sleeve;

said first lens cap removably coupled to said first upper portion of said first lens cover sleeve;

said first lens removably disposed between said first lens cap and said first lens cover sleeve;

a second scope lens cover including a second lens cover sleeve, a second lens cap, and a second lens;

said second lens cover sleeve including a tubular body having a length disposed between a second upper portion and a second lower portion of said tubular body and a second internal surface of said tubular body generally decreasing from said second lower portion of said second lens cover sleeve toward said second upper portion of said second lens cover sleeve;

said second lens cap removably coupled to said second upper portion of said second lens cover sleeve;

said second lens removably disposed between said second lens cap and said second lens cover sleeve;

mateable threads disposed on at least one of said first lens cap or said second lens cap and correspondingly disposed on at least one of said upper portion of said first or second lens cover sleeve; and an elastic cord coupled to said first lower portion of said first lens cover sleeve and said second lower portion of said lens cover sleeve.

2. The system of claim 1, further comprising a plurality of first attachment ears coupled to said first lens cover sleeve and a plurality of second attachment ears coupled to said second lens cover, wherein said elastic cord comprises a plurality of elastic cords each having a first end coupled to a corresponding one of said plurality of first attachment ears and a second end each of said plurality of elastic cords coupled to a corresponding one of said plurality of second attachment ears.

3. The system of claim 2, wherein said plurality of elastic cords comprised of rubber or stretch cord.

4. The system of claim 3, wherein said plurality of elastic cords consists of two elastic cords.

5. The system of claim 1, further comprising a first plurality of grippers disposed on the exterior surface of said first lens cap and a second plurality of grippers disposed on the exterior surface of said second lens cap.

6. The system of claim 1, wherein each of said first lens cap and said second lens cap removably coupled to said corresponding upper portion of said first lens cover sleeve and said second lens cover sleeve by mateable threads, said mateable threads disposed on an exterior surface of said upper portion of said first and second lens cover sleeve and disposed on an interior surface of said first and second lens caps.

7. The system of claim 6, wherein said lower portion of said first lens cover sleeve having a configuration selected from the group consisting of: an annular shape, an ellipse, a square, a four-sided shape consisting of two rounded sides and a flat top and bottom, a circle with an indentation on the bottom curve, or combination thereof.

8. The system of claim 7, wherein said lower portion of said second lens cover sleeve having a configuration selected from the group consisting of: an annular shape, an ellipse, a square, a four-sided shape consisting of two rounded sides and a flat top and bottom, a circle with an indentation on the bottom curve, or combination thereof.

9. The system of claim 8, wherein at least one of said first lens and second lens selected from the group consisting of: a clear lens, shaded lens, colored lens, polarized lens, amber lens, smoke lens, glass lens, polycarbonate lens, anti-glare lens, UV-blocker lens, or combination thereof.

10. A method, comprising:

obtaining an interchangeable scope lens covers system, including:

a first scope lens cover having a first lens cover sleeve, a first lens cap, and a first lens;

said first lens cover sleeve including a tubular body having a length disposed between a first upper portion and a first lower portion of said tubular body and a first internal surface of said tubular body generally decreasing from said first lower portion of said first lens cover sleeve toward said first upper portion of said first lens cover sleeve;

said first lens cap removably coupled to said first upper portion of said first lens cover sleeve;

said first lens removably disposed between said first lens cap and said first lens cover sleeve;

a second scope lens cover having a second lens cover sleeve, a second lens cap, and a second lens;

said second lens cover sleeve including a tubular body having a length disposed between a second upper portion and a second lower portion of said tubular body and a second internal surface of said tubular body generally decreasing from said second lower portion of said second lens cover sleeve toward said second upper portion of said second lens cover sleeve;

said second lens cap removably coupled to said second upper portion of said second lens cover sleeve;

said second lens removably disposed between said second lens cap and said second lens cover sleeve; and mateable threads disposed on at least one of said first lens cap or second lens cap and correspondingly disposed on at least one of said upper portion of said first or second lens cover sleeve:

an elastic cord coupled to said first lower portion of said first lens cover sleeve and said second lower portion of said lens cover sleeve;

positioning said first lens scope cover over a first end of a scope;

stretching said elastic cord; and positioning said second lens scope cover over a second end of said scope.

11. The method of claim 10, further comprising uncoupling said first lens cap, removing said first lens, disposing a third lens between said first lens cap and said first upper portion of said first lens cover sleeve, and coupling said first lens cap to said first upper portion of said first lens cover sleeve.

12. The method of claim 11, further comprising uncoupling said second lens cap, removing said second lens, disposing a fourth lens between said second lens cap and said second upper portion of said second lens cover sleeve, and coupling said second lens cap to said second upper portion of said second lens cover sleeve.

13. The method of claim 12, wherein stretching said elastic cord comprises stretching a plurality of elastic cords each having a first end coupled to a corresponding one of a plurality of first attachment ears coupled to said lower portion of said first lens cover sleeve and a second end coupled to a corresponding one of said plurality of second attachment ears coupled to said lower portion of said second lens cover sleeve.

14. The method of claim 13, wherein said plurality of elastic cords comprised of rubber or stretch cord.

15. The method of claim 13, wherein said plurality of elastic cords consists of two elastic cords.

16. The method of claim 10, further comprising gripping a first plurality of grippers disposed on the exterior surface of said first lens cap and gripping a second plurality of grippers disposed on the exterior surface of said second lens cap.

17. The method of claim 10, further comprising removably coupling each of said first lens cap and said second lens cap to said corresponding upper portion of said first lens cover sleeve and said second lens cover sleeve by operation of mateable threads disposed on an exterior surface of said upper portion of said first and second lens cover sleeve and disposed on an interior surface of said first and second lens caps.

18. The method of claim 10, wherein said lower portion of said first lens cover sleeve having a configuration selected from the group consisting of an annular shape, an ellipse, a square, a four-sided shape consisting of two rounded sides and a flat top and bottom, a circle with an indentation on the bottom curve, or combination thereof.

19. The method of claim 18, wherein said lower portion of said second lens cover sleeve having a configuration selected from the group consisting of: an annular shape, an ellipse, a square, a four-sided shape consisting of two rounded sides and a flat top and bottom, a circle with an indentation on the bottom curve, or combination thereof.

20. The method of claim 19, wherein at least one of said first lens and said second lens selected from the group consisting of: a clear lens, shaded lens, colored lens, polarized lens, amber lens, smoke lens, glass lens, polycarbonate lens, anti-glare lens, UV-blocker lens, or combination thereof.

* * * * *